US007294605B2

(12) United States Patent
Loccufier et al.

(10) Patent No.: US 7,294,605 B2
(45) Date of Patent: Nov. 13, 2007

(54) THERMOGRAPHIC RECORDING MATERIALS CONTAINING A MESIONIC, 1,2,4-TRIAZOLIUM-3-THIOLATE COMPOUND

(75) Inventors: Johan Loccufier, Zwijnaarde (BE); Ingrid Geuens, Emblem (BE)

(73) Assignee: AGFA-Healthcare, Mortsel (BE)

( * ) Notice: Subject to any disclaimer, the term of this patent is extended or adjusted under 35 U.S.C. 154(b) by 411 days.

(21) Appl. No.: 11/007,487

(22) Filed: Dec. 8, 2004

(65) Prior Publication Data

US 2005/0142506 A1 Jun. 30, 2005

Related U.S. Application Data

(60) Provisional application No. 60/536,192, filed on Jan. 13, 2004.

(30) Foreign Application Priority Data

Dec. 18, 2003 (EP) ..... 03104793

(51) Int. Cl.
*B41M 5/30* (2006.01)

(52) U.S. Cl. ..... 503/201; 503/212

(58) Field of Classification Search ..... None
See application file for complete search history.

(56) References Cited

U.S. PATENT DOCUMENTS

| | | | |
|---|---|---|---|
| 3,074,809 | A | 1/1963 | Owen |
| 3,446,648 | A | 5/1969 | Workman |
| 3,844,797 | A | 10/1974 | Willems et al. |
| 3,951,660 | A | 4/1976 | Hagemann et al. |
| 4,351,896 | A | 9/1982 | Altland et al. |
| 4,378,424 | A | 3/1983 | Altland et al. |
| 4,404,390 | A | 9/1983 | Altland et al. |
| 4,411,984 | A | 10/1983 | Gabrielsen |
| 5,464,738 | A | 11/1995 | Lynch et al. |
| 5,496,695 | A | 3/1996 | Simpson et al. |
| 5,545,505 | A | 8/1996 | Simpson |
| 5,545,507 | A | 8/1996 | Simpson et al. |
| 5,545,515 | A | 8/1996 | Murray et al. |
| 5,558,983 | A | 9/1996 | Simpson et al. |
| 5,599,647 | A | 2/1997 | Defieuw et al. |
| 5,635,339 | A | 6/1997 | Murray |
| 5,654,130 | A | 8/1997 | Murray |
| 6,207,614 | B1 | 3/2001 | Defieuw et al. |
| 6,306,571 | B1 | 10/2001 | Vandenabeele et al. |

FOREIGN PATENT DOCUMENTS

| | | |
|---|---|---|
| EP | 0 600 587 A1 | 6/1994 |
| EP | 0 622 217 B1 | 11/1994 |
| EP | 0 654 355 B1 | 5/1995 |
| EP | 0 692 773 B1 | 1/1996 |
| EP | 0 713 133 A1 | 5/1996 |
| EP | 0 736 799 B1 | 10/1996 |
| EP | 0 901 040 A1 | 3/1999 |
| EP | 0 903 625 B1 | 3/1999 |
| EP | 0 964 300 B1 | 12/1999 |
| GB | 1 439 478 | 6/1976 |
| JP | 05-107764 | 4/1993 |
| JP | 5107764 | 4/1993 |
| JP | 2002-293039 | 10/2002 |
| JP | 2002293039 | 10/2002 |
| WO | WO 94/16361 A1 | 7/1994 |

OTHER PUBLICATIONS

Anonymus, Mesoinic silver halide stabilizer precursor in a heat developable and heat stabilizable photographic silver halide material and process, *Research Disclosure*, Mar. 1981, vol. 203, No. 38, Kenneth Mason Publications, Hampshire, GB.

Search Report for EP 03 10 4793 (Apr. 28, 2004).

Brinkman (ed.); Unconventional Imaging Processes, 74-75, New York, NY, Focal Press Limited (1978).

Cohen (ed.); *Modern Coating and Drying Technology*, New York, NY, VCH Publishers Inc. (1990).

Harbison et al., The Theory of the Photographic Process 4rth edition (James ed.), Chapter 13, 374, Macmillan Company, New York, NY (1977).

Klosterboer; Imaging Processes and Materials Neblette's 8th Edition (Sturge (ed.), Chapter 9, 279-291, Van Nostrand Reinhold, New York, NY (1989).

Zou et al.; Journal of Imaging and Science Technology, 40, 2, 94-103 (1996).

*Primary Examiner*—Bruce H. Hess
(74) *Attorney, Agent, or Firm*—Leydig, Voit & Mayer, Ltd

(57) ABSTRACT

A substantially light-insensitive black and white monosheet thermographic recording material comprising a support and a thermosensitive element, the thermosensitive element containing a substantially light-insensitive organic silver salt, an organic reducing agent therefor in thermal working relationship therewith, a binder and at least one mesionic 1,2,4-triazolium-3-thiolate compound.

11 Claims, No Drawings

THERMOGRAPHIC RECORDING MATERIALS CONTAINING A MESIONIC, 1,2,4-TRIAZOLIUM-3-THIOLATE COMPOUND

This application claims the benefit of U.S. Provisional Application No. 60/536,192 filed Jan. 13, 2004, which is herein incorporated by reference. In addition, this application claims the benefit of European Application No. 03104793.9 filed Dec. 18, 2003, which is also herein incorporated by reference.

FIELD OF THE INVENTION

The present invention concerns substantially light-insensitive thermographic recording materials containing at least one mesionic 1,2,4-triazolium-3-thiolate compound.

BACKGROUND OF THE INVENTION

Thermography is an image-forming process including a heating step and hence includes photothermography in which the image-forming process includes image-wise exposure and direct thermal processes in which the image-forming process includes an image-wise heating step. In direct thermal printing a visible image pattern is produced by image-wise heating of a recording material.

U.S. Pat. No. 4,378,424 discloses in a heat developable and heat stabilizable photographic silver halide element comprising a support having thereon, in reactive association, in binder: (a) photographic silver halide, (b) a photographic silver halide developing agent, (c) an activating concentration of a thermal base releasing compound, the improvement comprising (d) a stabilizing concentration of a mesoionic 1,2,4-triazolium-3-thiolate silver halide stabilizer.

U.S. Pat. No. 4,351,896 discloses in a heat developable and heat stabilizable photographic silver halide element comprising a support having thereon, in reactive association, in binder: (a) photographic silver halide, (b) a photographic silver halide developing agent, (c) an activating concentration of a thermal base releasing compound, the improvement comprising (d) a stabilizing concentration of a mesoionic 1,2,4-triazolium-3-thiolate silver halide stabilizer precursor containing a heat releasable blocking group on the sulfur atom.

U.S. Pat. No. 4,404,390 discloses a mesoionic 1,2,4-triazolium-3-thiolate precursor represented by the formula:

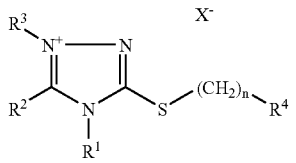

wherein: $R^1$ is alkyl containing 1 to 18 carbon atoms, —N(—$R^6$)$R^5$, alkenyl containing 3 to 18 carbon atoms, cycloalkyl containing 3 to 12 carbon atoms, or aryl containing 6 to 20 carbon atoms; $R^2$ is alkyl containing 1 to 9 carbon atoms or aryl containing 6 to 12 carbon atoms; $R^3$ is alkyl containing 1 to 18 carbon atoms, aryl containing 6 to 20 carbon atoms, or cycloalkyl containing 3 to 12 carbon atoms; $R^4$ is carboxyaryl containing 7 to 13 carbon atoms, cyano (CN) or amido ($CONH_2$); $R^5$ and $R^6$ are individually hydrogen, alkyl containing 1 to 18 carbon atoms, or aryl containing 6 to 20 carbon atoms, provided that when one of $R^5$ and $R^6$ is alkyl then both $R^5$ and $R^6$ are alkyl; n is 1 or 2; and X is an acid anion.

U.S. Pat. No. 4,351,896 and U.S. Pat. No. 4,404,390 disclose mesionic silver halide stabilizer precursors, which upon thermal processing form a stabilizer moiety which reacts with the silver halide in unexposed areas to form a stable silver (I) salt. However, U.S. Pat. No. 4,351,896 and U.S. Pat. No. 4,404,390 are silent in respect of their use in substantially light-insensitive thermographic recording-materials whose thermosensitive element contains a substantially light-insensitive organic silver salt and a reducing agent therefor.

U.S. Pat. No. 4,411,984 in a photographic element comprising a support having thereon, in reactive association, in binder, photographic silver halide and a dye precursor, the improvement wherein, said dye precursor is a diphenylamine having, in an ortho position to the amine, a sulfonyldiamido group that is capable upon oxidation of said diphenylamine of releasing a sulfonylamine fragment which, in turn, is capable of thermally releasing ammonia or an amine and wherein said diphenylamine is capable upon oxidation of forming a phenazine dye. U.S. Pat. No. 4,404,390 further discloses 1,5-dimethyl-6-allyl-1,2,4-triazolium-3-thiolate as a development accelerator in the photographic element.

JP 05-107764 discloses a silver halide photosensitive material capable of stably giving a high density image with low fog independently of a change in processing conditions and inhibiting the lowering of the sensitivity during storage in the raw state, the photosensitive material comprising a polymerizable photosensitive layer containing silver halide, a reducing agent and a polymerizable compound formed on a substrate, a mesoionic compound represented by the formula is incorporated into the photosensitive polymerizable layer:

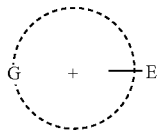

wherein G is a 5- or 6-membered ring having N, O, S and/or Se as a hetero atom, E is —O—, —S— or —N-D (where D is alkyl, cycloalkyl, alkenyl, alkynyl, aralkyl, aryl or a heterocyclic group) and G may have a substituent. JP 05-107764 further discloses that the mesoionic compound is a compound represented by formula (II):

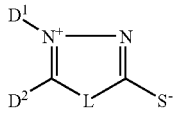

wherein $D^1$ is an alkyl, cycloalkyl, alkynyl, aralkyl, aryl or heterocyclic group; $D^2$ is a hydrogen atom or an alkyl, cycloalkyl, alkeynyl, aralyly, aryl or heterocyclic group; L is —O—, —S—, or —N($D^3$)-; and $D^3$ is an alkyl, cycloalkyl, alkynyl, aralkyl, aryl or heterocyclic, amino, acylamino, sulfonamido, ureido or sulfamoylamino; and $D^1$ and $D^2$ and $D^2$ and $D^3$ may represent the atoms needed to form a ring.

EP-A 0 713 133 discloses a thermal imaging system consisting of (i) a donor element comprising on a support a donor layer containing a binder and a thermotransferable reducing agent capable of reducing a silver source to metallic silver and (ii) a receiving element comprising on a support a receiving layer comprising a silver source, capable of being reduced by means of heat in the presence of a reducing agent, a binder and a stabiliser selected from the group consisting of benzotriazoles, heterocyclic mercaptanes, sulphinic acids, 1,3,4-triazo-indinolines, 1,3-dinitroaryl compounds, 1,2,3-triazoles, phthalic acids and phthalic acid derivatives.

EP-A 0 901 040 discloses a substantially light-insensitive monosheet recording material comprising a support and a thermosensitive element containing a substantially light-insensitive organic silver salt, an organic reducing agent therefor in thermal working relationship therewith and a binder, characterized in that said thermosensitive element further contains an unsaturated carbocyclic or heterocyclic stabilizer compound substituted with a—SA group where A is hydrogen, a counterion to compensate the negative charge of the thiolate group or a group forming a symmetrical or an asymmetrical disulfide and said recording material is capable of producing prints with a numerical gradation value defined as the quotient of the fraction $(2.5-0.1)/(E_{2.5}-E_{0.1})$ greater than 2.3, where $E_{2.5}$ is the energy in Joule applied in a dot area of 87 μm×87 μm of the imaging layer that produces an optical density value of 2.5, and $E_{0.1}$ is the energy in Joule applied in a dot area of the imaging layer material that produces an optical density value of 0.1.

WO 94/16361 discloses a multilayer heat-sensitive material which comprises: a color-forming layer comprising: a color-forming amount of finely divided, solid colorless noble metal or iron salt of an organic acid distributed in a carrier composition; a color-developing amount of a cyclic or aromatic organic reducing agent, which at thermal copy and printing temperatures is capable of a color-forming reaction with the noble metal or iron salt; and an image-toning agent; characterized in that (a) the carrier composition comprises a substantially water-soluble polymeric carrier and a dispersing agent for the noble metal or iron salt and (b) the material comprises a protective overcoating layer for the color-forming layer. Furthermore, WO 94/16361 discloses that suitable antifoggants are well-known photographic anti-foggants such as mercaptobenzotriazole, chromate, oxalate, citrate, carbonate, benzotriazole (BZT), 5-methylbenzotriazole, 5,6-dimethylbenzotriazole, 5-bromobenzotriazole, 5-chlorobenzotriazole, 5-nitro-benzotriazole, 4-nitro-6-chlorobenzotriazole, 5-nitro-6-chlorobenzotriazole, 4-hydroxy-6-methyl-1,3,3a,7-tetraazaindene, benzimidazole, 2-methylbenz-imidazole, 5-nitrobenzimidazole, 1-phenyl-5-mercaptotetrazole, 2-mercaptobenzimidazole, 2-mercaptobenzothiazole, 2-mercaptobenzoxazole, 2-mercaptothiazoline, 2-mercapto-4-methyl-6,6'-dimethylpyrimidine, 1-ethyl-2-mercapto-5-amino-1,3,4-triazole, 1-ethyl-5-mercapto-1,2,3,4-tetrazole, 2,5-dimercapto-1,3,4-thiodiazole, 2-mercapto-5-aminothiodiazole, dimethyldithiocarbamate, and diethyldithiocarbamate.

JP 2002-293039A discloses a monochromatic or multicolour image-forming material comprising an image-forming layer containing a dye precursor and a deblocking agent for generating the dye by reacting with the precursor of the surface of a support, wherein the deblcoking agent is a mesionic compound, but is silent in respect of the use of mesionic compounds in substantially light-insensitive thermographic recording materials whose thermosensitive element contains a substantially light-insensitive organic silver salt and a reducing agent therefor.

U.S. Pat. No. 6,306,571 discloses a process for producing an aqueous dispersion containing particles of a substantially light insensitive silver salt A, said silver salt A being a salt of a carboxylic acid having a solubility of less than $10^{-3}$ g in 100 ml of water at 20° C., said process consisting essentially of: (a) preparing an aqueous dispersion containing particles of a silver salt B, said silver salt B having a solubility of between 0.001 g and 1.5 g in 100 ml of water at 20° C., wherein the media for said aqueous dispersion is selected from the group consisting of water and mixtures of water and water-miscible organic solvents; and (b) reacting said particles of said silver salt B in the aqueous dispersion formed in step (a) with a solution of a conversion agent, wherein said conversion agent is a water soluble salt of the carboxylic acid, thereby forming the aqueous dispersion of particles of said substantially light insensitive silver salt A. U.S. Pat. No. 6,306,571 further discloses the presence of stabilizers and antifoggants in the thermographic and photothermographic materials and in an extensive list mentions the mesoionic 1,2,4-triazolium-3-thiolate precursors described in U.S. Pat. No. 4,404,390 and U.S. Pat. No. 4,351,896 and also tribromomethyl ketone compounds described in EP-A 600 587. As is explained below, one: skilled in the art would know that the stabilizing and antifoggant requirements for photothermographic materials containing a substantially light-insensitive silver salt, a reducing agent therefor and photosensitive silver halide are completely different from those for thermographic materials containing a substantially light-insensitive silver salt and a reducing agent therefor. Therefore, in respect of compounds known to stabilize photothermographic materials, such as mesoionic 1,2,4-triazolium-3-thiolate precursors and tribromomethyl ketone compounds, one skilled in the art would, in a list of stabilizers for both photothermographic and thermographic materials, associate these stabilizers with photothermographic materials and would have no expectation of stabilizing properties in respect of substantially light-insensitive thermographic materials.

Differences Between Thermography and Photography

The imaging arts have long recognized that the field of thermography comprising both photothermography and substantially light-insensitive thermography are clearly distinct from that of photography. Photothermographic and substantially light-insensitive thermographic materials differ significantly from conventional silver halide photographic materials which require processing using aqueous processing solutions.

In photothermographic and substantially light-insensitive thermographic imaging materials, a visible image is created by heat as a result of the reaction of a developer incorporated within the element. Heat at 50° C. or more is essential for this development process and temperatures of over 100° C. are routinely required for photothermographic materials and still higher temperatures are routinely required for substantially light-insensitive thermographic materials. In contrast, conventional wet-processed photographic imaging elements require processing in aqueous processing baths to provide a visible image (e.g., developing and fixing baths) and development is usually performed at more moderate temperatures (e.g., 30° to 50° C.) to provide a visible image.

In photothermographic elements only a small amount of silver halide is used to capture light and a different sort of silver (e.g., silver behenate) is used to generate the image with heat. Thus imaged, the silver halide serves as a catalyst for the physical development process involving the non-photosensitive, reducible silver source and the incorporated reducing agent. In contrast, conventional wet-processed black-and-white photographic materials use only one form of silver (i.e. silver halide) that, upon chemical development, is itself converted into the silver image, or upon physical development requires addition of an external silver source (or other reducible metal ions that form black images upon reduction to the corresponding metal). Thus, photothermographic materials require an amount of silver halide per unit area that is only a fraction of that used (as little as one-hundredth) of that used in a conventional wet-processed photographic material.

Moreover, in photothermographic systems, all of the "chemistry" for imaging is incorporated within the material itself. For example, such materials include a developer (i.e. a reducing agent for the reducible silver ions) while photographic materials usually do not. Even in so-called "instant photography", the developer chemistry is physically separated from the photosensitive silver halide until development is desired. The incorporation of the developer into substantially light-insensitive thermographic and photothermographic materials can lead to the increased formation of various types of "fog" or other undesirable sensitometric side effects. Therefore, much effort has gone into the preparation and manufacture of substantially light-insensitive thermographic and photothermographic materials to minimize these problems during the preparation of the substantially light-insensitive thermographic and photothermographic dispersions as well as during coating, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (i.e. in the aqueous fixing step).

In photothermographic and substantially light-insensitive thermographic materials, the binder is capable of wide variation and a number of binders (both hydrophilic and hydrophobic) are useful. In contrast, conventional photographic materials are limited almost exclusively to hydrophilic binders such as gelatin.

Because photothermographic and substantially light-insensitive thermographic elements require thermal processing, they pose different considerations and present distinctly different problems in manufacture and use, compared to conventional wet-processed silver halide photographic materials. Additives that have one effect in conventional silver halide photographic materials may behave quite differently when incorporated in substantially light-insensitive thermographic or photothermographic materials where the underlying chemistry is significantly more complex. The incorporation of such additives as, for example, stabilizers, antifoggants, speed enhancers, sensitizers, supersensitizers and spectral and chemical sensitizers in conventional photographic materials is not predictive of whether such additives will prove beneficial or detrimental in substantially light-insensitive thermographic or photothermographic materials. For example, it is not uncommon for a photographic antifoggant useful in conventional photographic materials to cause various types of fog when incorporated into substantially light-insensitive thermographic or photothermographic materials, or for supersensitizers that are effective in photographic materials to be inactive in photothermographic materials.

These and other distinctions between photothermographic and substantially light-insensitive thermographic materials and photographic materials are described in *Imaging Processes and Materials* (*Neblette's Eighth Edition*); J. Sturge et al, Ed; Van Nostrand Rheinhold: New York, 1989; Chapter 9 and in *Unconventional Imaging processes*; E. Brinckman et al., Ed: The focal Press: London and New York: 1978: pp. 74-75, and in Zou, Sahyun, Levy and Serpone, *J. Imaging Sci. Technol.* 1996, 40, pp. 94-103.

Differences Between Substantially Light-Insensitive Thermographic Recording Materials and Photothermographic Recording Materials The technology of substantially light-insensitive thermographic materials in which image formation is based on the reduction of organic silver salts is significantly different from that of photothermographic recording materials, despite the fact that in both cases the image results from the reduction of organic silver salts. However, this a superficial similarity masking the fact that the realization of the species which catalyze this reduction is completely different, being image-wise exposure of photosensitive silver halide-containing photo-addressable thermally developable elements in the case of photothermographic recording materials and image-wise heating of thermosensitive elements which do not contain photosensitive silver halide in the case of thermographic recording materials. This difference in technology is further underlined by the nature of the ingredients used in the two types of materials, the most significant difference being the absence of photosensitive silver halide and spectral sensitizing agents in substantially light-insensitive thermographic recording materials, but also reflected in the different reducing agents used, stronger reducing agents being used in substantially light-insensitive thermographic recording materials, the different stabilizers, the different toning agents etc. Furthermore, the thermal development processes themselves are significantly different in that the whole material is heated at temperatures of less than 150° C. for periods of seconds (e.g. 10 s) in the case of photothermographic recording materials, whereas in the case of substantially light-insensitive thermographic recording materials the materials are image-wise heated at much higher temperatures for periods of ms (e.g. 10-20 ms). Realization of a neutral image tone is a major problem in the case of substantially light-insensitive thermographic recording materials due to the very short heating times, whereas it is much less of a problem in photothermographic recording materials due to the much longer heating times.

Problem to be Solved

In substantially light-insensitive thermographic recording materials image-forming results from the reduction of at least one substantially light-insensitive organic silver salt by at least one reducing agent. However, this image-forming reaction does not proceed to completion due to some unknown retarding effect. This results in inefficient utilization of the substantially light-insensitive organic silver salt present and hence the necessary presence of an excess of the most expensive ingredient. There is therefore a need for compounds which enable the reduction of at least one substantially light-insensitive organic silver salt by at least one reducing agent in substantially light-insensitive thermographic recording materials to proceed more efficiently, thereby increasing the Dmax attainable for a given coverage per unit area of substantially light-insensitive organic silver salt.

ASPECTS OF THE INVENTION

It is therefore an aspect of the present invention to provide compounds which endow substantially light-insensitive thermographic recording materials with a higher Dmax for a given coverage of organic silver salt per unit area.

It is therefore a further-aspect of the present invention to provide compounds which enable the reduction of at least one substantially light-insensitive organic silver salt by at least one reducing agent in substantially light-insensitive thermographic recording materials to proceed more efficiently, thereby increasing the Dmax attainable for a given coverage per unit area of substantially light-insensitive organic silver salt.

Further aspects and advantages of the invention will become apparent from the description hereinafter.

SUMMARY OF THE INVENTION

It has been surprisingly found that mesionic 1,2,4-triazolium-3-thiolate compounds enable the reduction of at least one substantially light-insensitive organic silver salt by at least one reducing agent in substantially light-insensitive thermographicrecordingmaterialstoproceedmoreefficiently, thereby increasing the Dmax attainable for a given coverage per unit area of substantially light-insensitive organic silver salt.

Aspects of the present invention are realized by a substantially light-insensitive black and white monosheet thermographic recording material comprising a support and a thermosensitive element, the thermosensitive element containing a substantially light-insensitive organic silver salt, an organic reducing agent therefor in thermal working relationship therewith, a binder and at least one mesionic 1,2,4-triazolium-3-thiolate compound.

Aspects of the present invention are also realized by a process comprising the steps of: i) providing a substantially light-insensitive black and white monosheet thermographic recording material comprising a support and a thermosensitive element, the thermosensitive element containing a substantially light-insensitive organic silver salt, an organic reducing agent therefor in thermal working relationship therewith, a binder and the at least one mesionic 1,2,4-triazolium-3-thiolate compound; and ii) image-wise heating the substantially light-insensitive black and white monosheet thermographic recording material, wherein the ratio of maximum optical density to the coverage of the substantially light-insensitive organic silver salt in $g/m^2$ is greater than the ratio of maximum optical density to the coverage of the substantially light-insensitive organic silver salt in $g/m^2$ the substantially light-insensitive black and white monosheet thermographic recording material in the absence of the at least one mesionic 1,2,4-triazolium-3-thiolate compound.

Preferred embodiments of the present invention are disclosed in the detailed description of the invention.

DETAILED DESCRIPTION OF THE INVENTION

Definitions

The term meso-ionic or mesionic, as used in disclosing the present invention, means any class of five-membered ring heterocycles and their benzo derivatives which possess a sextet of pi electrons in association with the atoms composing the ring but which cannot be represented satisfactorily by one covalent or polar structure.

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl etc.

The term acyl group as used in disclosing the present invention means —(C═O)-aryl and —(C═O)-alkyl groups.

The L*, a* and b* CIELAB-values are defined in ASTM Norm E179-90 in a R(45/0) geometry with evaluation according to ASTM Norm E308-90.

Substantially light-insensitive means not intentionally light sensitive.

Heating in association with the expression a substantially water-free condition as used herein, means heating at a temperature of 80 to 250° C. The term "substantially water-free condition" as used herein means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Thermosensitive Element

The term thermosensitive element as used herein is that element which contains all the ingredients which contribute to image formation. According to the present invention, the thermosensitive element contains one or more substantially light-insensitive organic silver salts, one or more reducing agents therefor in thermal working relationship therewith and a binder. The element may comprise a layer system in which the above-mentioned ingredients may be dispersed in different layers, with the proviso that the substantially light-insensitive organic silver salts are in reactive association with the reducing agents i.e. during the thermal development process the reducing agent must be present in such a way that it is able to diffuse to the particles of substantially light-insensitive organic silver salt so that reduction to silver can occur. Such materials include the possibility of one or more substantially light-insensitive organic silver salts and/or one of more organic reducing agents therefor being encapsulated in heat-responsive microcapsules, such as disclosed in EP-A 0 736 799 herein incorporated by reference.

Mesionic 1,2,4-triazolium-3-thiolate Compounds

Aspects of the present invention are realized with a substantially light-insensitive black and white monosheet thermographic recording material comprising a support and a thermosensitive element, the thermosensitive element containing a substantially light-insensitive organic silver salt, an organic reducing agent therefor in thermal working relationship therewith, a binder and at least one mesionic 1,2,4-triazolium-3-thiolate compound.

According to first embodiment of the substantially light-insensitive black and white monosheet thermographic recording material, according to the present invention, the mesionic 1,2,4-triazolium-3-thiolate compound is represented by formula (I):

(I)

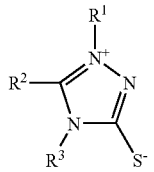

wherein $R^1$ and $R^3$ are independently an optionally substituted alkyl, alkenyl, alkynyl, cycloalkyl, heterocyclic, aryl, heteroaromatic, amido, carboxy, carboxy ester or acyl group; $R^2$ is a hydrogen or an optionally substituted alkyl, alkenyl, alkynyl, cycloalkyl, heterocyclic, aryl, heteroaromatic, alkoxy, thioalkoxy, carboxy, amido, carboxy ester, acyl, carbonato or carbonatoalkyl group; or $R^1$ and $R^2$ or $R^2$ and $R^3$ represent the atoms needed to close an optionally substituted heterocyclic ring.

According to second embodiment of the substantially light-insensitive black and white monosheet thermographic recording material, according to the present invention, the mesionic 1,2,4-triazolium-3-thiolate compound is represented by formula (I):

(I)

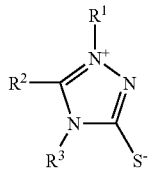

wherein $R^1$ and $R^3$ are independently an optionally substituted alkyl, alkenyl, alkynyl, cycloalkyl, heterocyclic, aryl, heteroaromatic, amido, carboxy, carboxy ester or acyl group; $R^2$ is a hydrogen or an optionally substituted alkyl, alkenyl, alkynyl, cycloalkyl, heterocyclic, aryl, heteroaromatic, alkoxy, thioalkoxy, carboxy, amido, carboxy ester, phosphoric acid ester, phosphoric acid, acyl, carbonato or carbonatoalkyl group; or $R^1$ and $R^2$ or $R^2$ and $R^3$ represent the atoms needed to close an optionally substituted heterocyclic ring; and the alkyl, alkenyl, alkynyl, cycloalkyl, aryl, heterocyclic and heteroaromatic groups of $R^1$, $R_2$ and $R^3$ are independently optionally substituted with fluorine atoms or an aryl, aryloxy, alkoxy, thioalkoxy, amido, carbonato, carbonatoalkyl, hydroxy, amino, carboxy or carboxyester group.

According to a third embodiment of the substantially light-insensitive black and white monosheet thermographic recording material, according to the present invention, the mesionic 1,2,4-triazolium-3-thiolate compound is represented by formula (I):

(I)

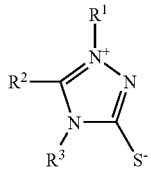

wherein $R^1$ and $R^3$ are independently an alkyl group, an alkyl group substituted with a carboxyester group, an alkenyl, or an aryl group; and $R^3$ is an alkyl group, preferably a $C_1$-$C_3$ alkyl group, and $R^1$, $R^2$ and $R^3$ are preferably not all methyl groups.

According to a fourth embodiment of the substantially light-insensitive black and white monosheet thermographic recording material, according to the present invention, the mesionic 1,2,4-triazolium-3-thiolate compound is selected from the group consisting of

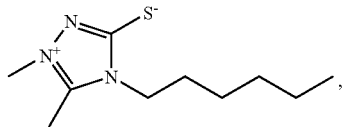

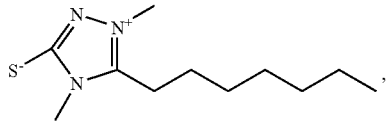

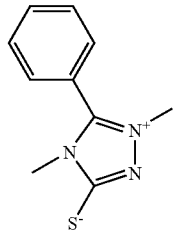

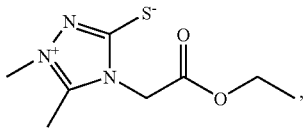

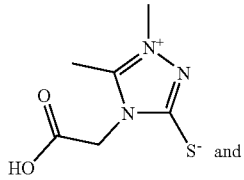

and

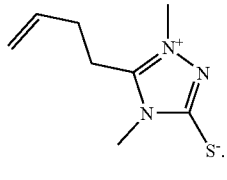

The mesionic 1,2,4-triazolium-3-thiolate (MTT) compounds used in the substantially light-insensitive thermographic recording materials of the present invention can be prepared using classical organic preparative techniques known to one skilled in the art.

Suitable mesionic 1,2,4-triazolium-3-thiolate (MTT) compounds, for use in the substantially light-insensitive thermographic recording materials, according to the present invention include:

| mesionic 1,2,4-triazolium-3-thiolate compound nr. | |
|---|---|
| MTT-01 | 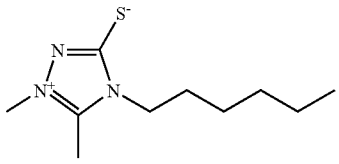 |
| MTT-02 | 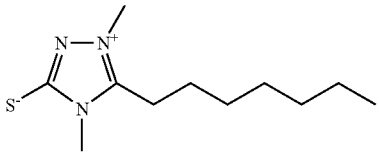 |
| MTT-03 | 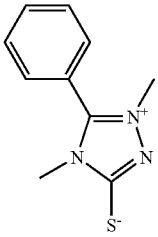 |
| MTT-04 | 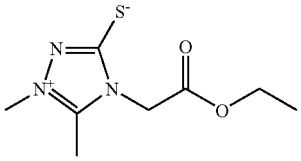 |
| MTT-05 | 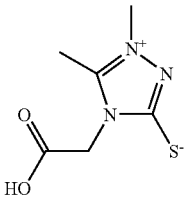 |
| MTT-06 | 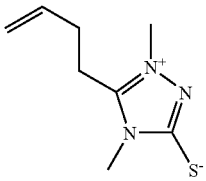 |
| MTT-07 | 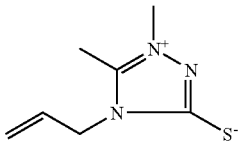 |
| MTT-08 | 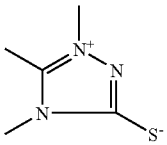 |

-continued
| mesionic 1,2,4-triazolium-3-thiolate compound nr. | |
|---|---|
| MTT-09 | 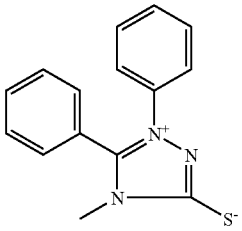 |
| MTT-10 | 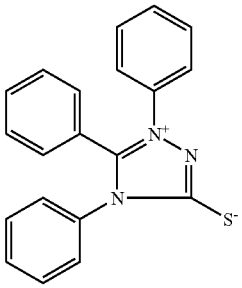 |
| MTT-11 | 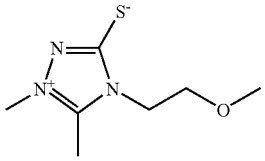 |
| MTT-12 | 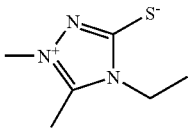 |
| MTT-13 | 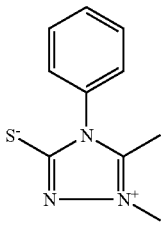 |
| MTT-14 | 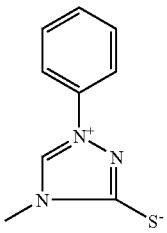 |

-continued
| mesionic 1,2,4-triazolium-3-thiolate compound nr. | |
|---|---|
| MTT-15 | 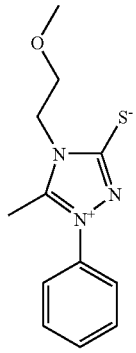 |
| MTT-16 | 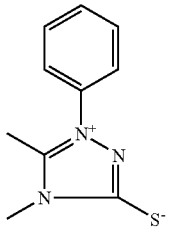 |
| MTT-17 | 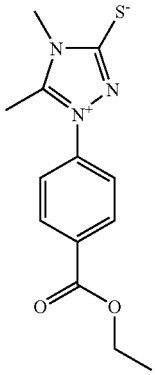 |
| MTT-18 | 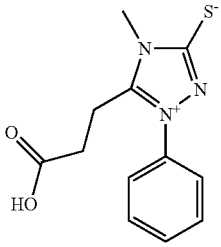 |
| MTT-19 | 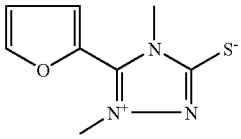 |
| MTT-20 | 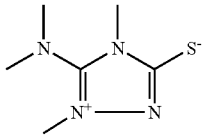 |

-continued
| mesionic 1,2,4-triazolium-3-thiolate compound nr. | |
|---|---|
| MTT-21 | 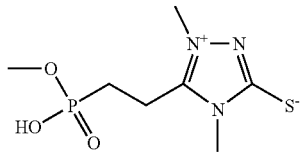 |
| MTT-22 | 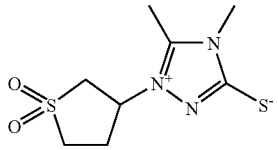 |
| MTT-23 | 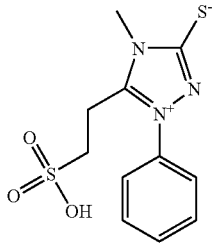 |
| MTT-24 | 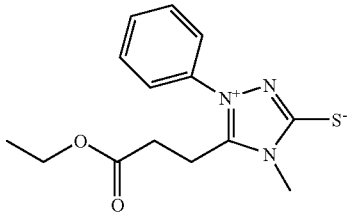 |
| MTT-25 | 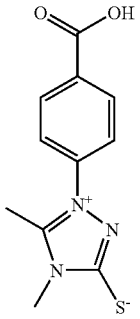 |
| MTT-26 | 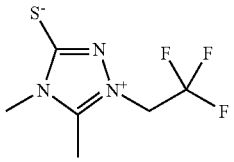 |
| MTT-27 | 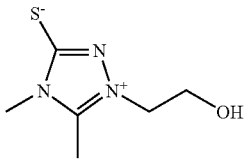 |

-continued
| mesionic 1,2,4-triazolium-3-thiolate compound nr. | |
|---|---|
| MTT-28 | 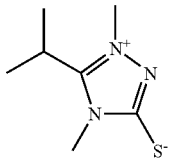 |
| MTT-29 | 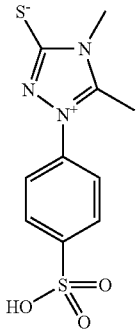 |
| MTT-30 | 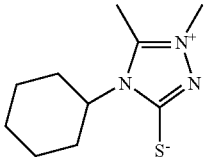 |
| MTT-31 | 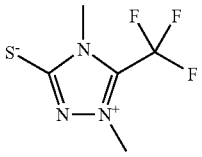 |
| MTT-32 | 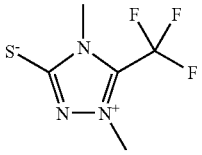 |
| MTT-33 | 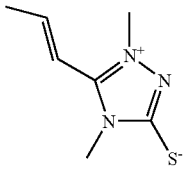 |
| MTT-34 | 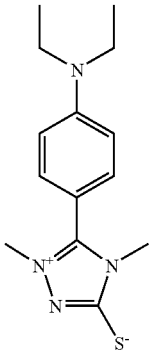 |

-continued
| mesionic 1,2,4-triazolium-3-thiolate compound nr. | |
|---|---|
| MTT-35 | 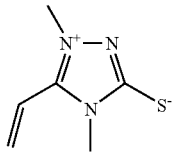 |
| MTT-36 | 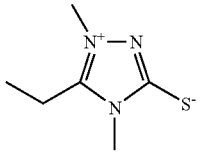 |
| MTT-37 | 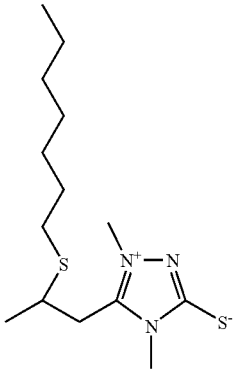 |
| MTT-38 | 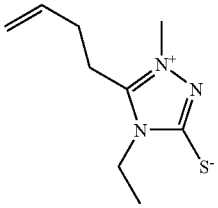 |
| MTT-39 | 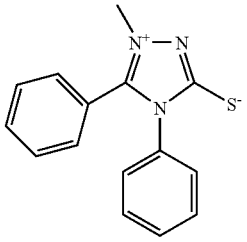 |
| MTT-40 | 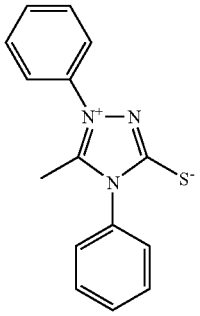 |

-continued
| mesionic 1,2,4-triazolium-3-thiolate compound nr. | |
|---|---|
| MTT-41 | 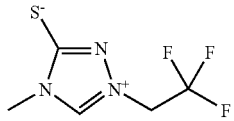 |
| MTT-42 | 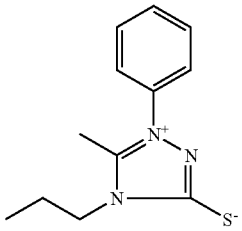 |
| MTT-43 | 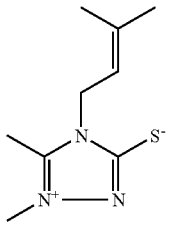 |
| MTT-44 | 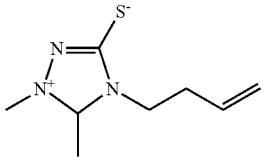 |
| MTT-45 | 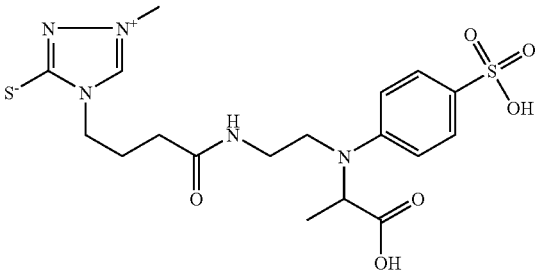 |
| MTT-46 | 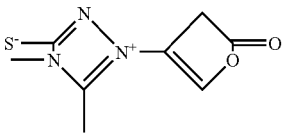 |
| MTT-47 | 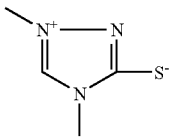 |

-continued
| mesionic 1,2,4-triazolium-3-thiolate compound nr. | |
|---|---|
| MTT-48 | 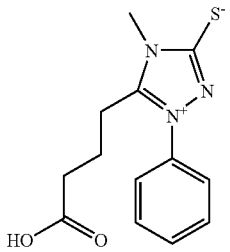 |
| MTT-49 | 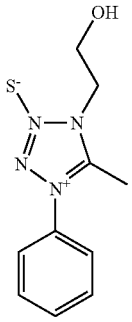 |
| MTT-50 | 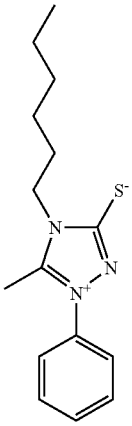 |
| MTT-51 | 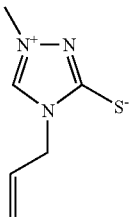 |
| MTT-52 | 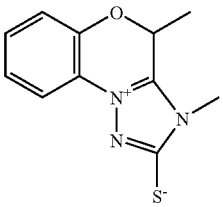 |

-continued
| mesionic 1,2,4-triazolium-3-thiolate compound nr. | |
|---|---|
| MTT-53 | 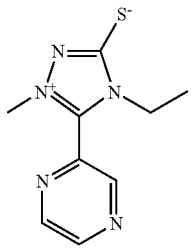 |
| MTT-54 | 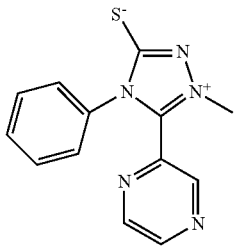 |
| MTT-55 | 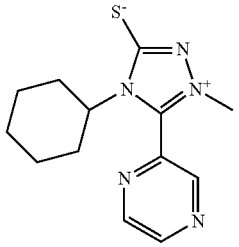 |
| MTT-56 | 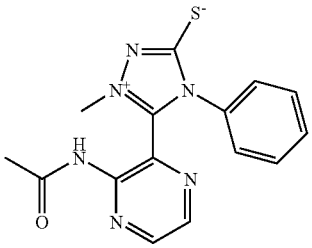 |
| MTT-57 | 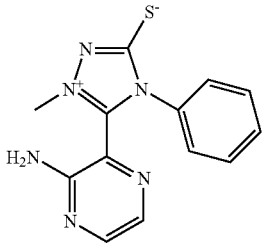 |
| MTT-58 | 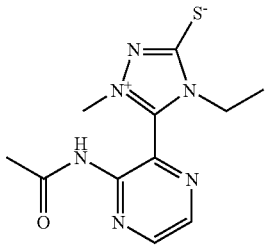 |

-continued
| mesionic 1,2,4-triazolium-3-thiolate compound nr. | |
|---|---|
| MTT-59 | 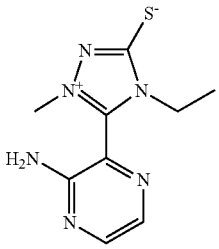 |
| MTT-60 | 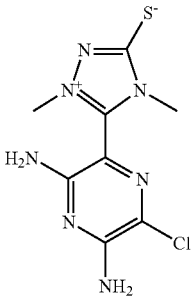 |
| MTT-61 | 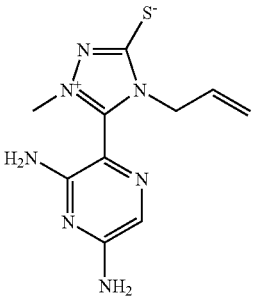 |
| MTT-62 | 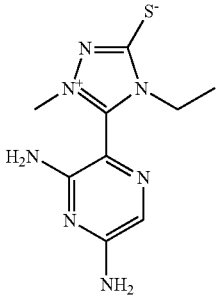 |
| MTT-63 | 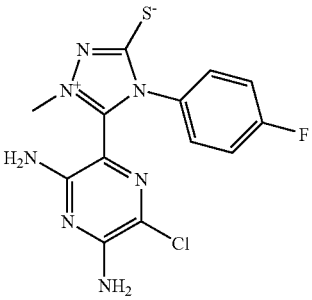 |

-continued

| mesionic 1,2,4-triazolium-3-thiolate compound nr. | |
|---|---|
| MTT-64 | 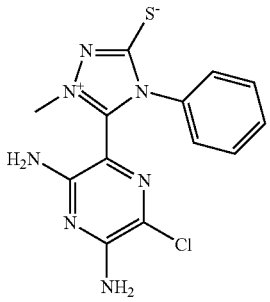 |

Organic Silver Salt

According to a fifth embodiment of the substantially light-insensitive black and white monosheet thermographic recording material of the present invention, the organic silver salts are not double organic salts containing a silver cation associated with a second cation e.g. magnesium or iron ions.

According to a sixth embodiment of the substantially light-insensitive black and white monosheet thermographic recording material of the present invention, at least one of the organic silver salts is a substantially light-insensitive silver salt of an organic carboxylic acid.

According to a seventh embodiment of the substantially light-insensitive black and white monosheet thermographic recording material of the present invention, at least one of the organic silver salts is a substantially light-insensitive silver salt of an aliphatic carboxylic acids known as a fatty acid, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salt of an organic carboxylic acids may also be used in the present invention, as disclosed in EP-A 964 300.

Organic silver salts may be dispersed by standard dispersion techniques. Ball mills, bead mills, microfluidizers, ultrasonic apparatuses, rotor stator mixers etc. have been found to be useful in this regard. Mixtures of organic silver salt dispersions produced by different techniques may also be used to obtain the desired thermographic properties e.g. of coarser and more finely ground dispersions of organic silver salts.

Reducing Agents

According to an eighth embodiment of the substantially light-insensitive black and white monosheet thermographic recording material, according to the present invention, the reducing agent is an organic compound containing at least one active hydrogen atom linked to O, N or C, such as is the case with, aromatic di- and tri-hydroxy compounds. 1,2-dihydroxy-benzene derivatives, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters are preferred, with those described in EP-A 0 692 733 and EP-A 0 903 625 being particularly preferred.

Combinations of reducing agents may also be used that on heating become reactive partners in the reduction of the one or more substantially light-insensitive organic silver salt. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. Nos. 5,635,339; and 2-substituted malonodialdehyde compounds as disclosed in U.S. Pat. No. 5,654,130.

Binder of the Thermosensitive Element

The film-forming binder of the thermosensitive element may be all kinds of natural, modified natural or synthetic resins or mixtures of such resins, in which the at least one organic silver salt can be dispersed homogeneously either in aqueous or solvent media: e.g. cellulose derivatives, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylates, polymethacrylates, polystyrene and polyethylene or mixtures thereof.

Suitable water-soluble film-forming binders for use insubstantially light-insensitive thermographic recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders, polysaccharides and water-soluble cellulose derivatives. A preferred water-soluble binder for use in the substantially light-insensitive thermographic recording materials of the present invention is gelatine.

The binder to organic silver salt weight ratio is preferably in the range of 0.2 to 7, and the thickness of the thermosensitive element is preferably in the range of 5 to 50 μm. Binders are preferred which do not contain additives, such as certain antioxidants (e.g. 2,6-di-tert-butyl-4-methylphenol), or impurities which-adversely affect the thermographic properties of the substantially light-insensitive thermographic recording materials in which they are used.

Toning Agent

According to a ninth embodiment of the substantially light-insensitive black and white monosheet thermographic recording material, according to the present invention, the thermosensitive element contains a toning agent, which enables a neutral black image tone to be obtained in the higher densities and neutral grey in the lower densities.

According to a tenth embodiment of the substantially light-insensitive black and white monosheet thermographic recording material, according to the present invention, the thermosensitive element further contains a toning agent selected from the group consisting of phthalimides, phthalazinones, benzoxazine diones and naphthoxazine diones e.g. phthalimides and phthalazinones within the scope of the general formulae described in U.S. Pat. No. 4,082,901; the toning agents described in U.S. Pat. Nos. 3,074,809, 3,446,648 and 3,844,797; and the heterocyclic toner compounds of the benzoxazine dione or naphthoxazine dione type as disclosed in GB 1,439,478, U.S. Pat. No. 3,951,660 and U.S. Pat. No. 5,599,647, herein incorporated by reference.

According to an eleventh embodiment of the substantially light-insensitive black and white monosheet thermographic recording material, according to the present invention, the substantially light-insensitive thermographic material contains a thermosensitive element, the thermosensitive element containing one or more toning agents selected from the group consisting of phthalazinone, benzo [e][1,3]oxazine-2,4-dione, 7-methyl-benzo [e][1,3]oxazine-2,4-dione, 7-methoxy-benzo [e][1,3]oxazine-2,4-dione and 7-(ethylcarbonato)-benzo [e][1,3]oxazine-2,4-dione.

Auxiliary Antifoggants

According to a twelfth embodiment of the substantially light-insensitive black and white monosheet thermographic recording material, according to the present invention, the substantially light-insensitive thermographic recording material further contains an auxiliary antifoggant to obtain improved shelf-life and reduced fogging.

According to a thirteenth embodiment of the substantially light-insensitive black and white monosheet thermographic recording material, according to the present invention, the substantially light-insensitive thermographic recording material further contains an antifoggant selected from the group consisting of benzotriazole, substituted benzotriazoles and aromatic polycarboxylic acid such as ortho-phthalic acid, 3-nitro-phthalic acid, tetrachlorophthalic acid, mellitic acid, pyromellitic acid and trimellitic acid and anhydrides thereof.

According to a fourteenth embodiment of the substantially light-insensitive black and white monosheet thermographic recording material, according to the present invention, the thermosensitive element further contains an optionally substituted benzotriazole.

Polycarboxylic Acids and Anhydrides thereof

According to a fifteenth embodiment of the substantially light-insensitive black and white monosheet thermographic recording material, according to the present invention, the thermosensitive element further contains at least one polycarboxylic acid and/or anhydride thereof in a molar percentage of at least 15 with respect to all the organic silver salt(s) present and in thermal working relationship therewith. The polycarboxylic acid may be aliphatic (saturated as well as unsaturated aliphatic and also cycloaliphatic) or an aromatic polycarboxylic acid, may be substituted and may be used in anhydride form or partially esterified on the condition that at least two free carboxylic acids remain or are available in the heat recording step.

Surfactants and Dispersants

Surfactants and dispersants aid the dispersion of ingredients which are insoluble in the particular dispersion medium. The substantially light-insensitive thermographic material used in the present invention may contain one or more surfactants, which may be anionic, non-ionic or cationic surfactants and/or one or more dispersants. Suitable dispersants are natural polymeric substances, synthetic polymeric substances and finely divided powders, e.g. finely divided non-metallic inorganic powders such as silica.

Support

According to a sixteenth embodiment of the substantially light-insensitive black and white monosheet thermographic recording material, according to the present invention, the support is transparent or translucent. It is preferably a thin flexible carrier made transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated thermosensitive element. The support may be dyed or pigmented to provide a transparent coloured background for the image.

Protective Layer

According to a seventeenth embodiment of the substantially light-insensitive black and white monosheet thermographic recording material, according to the present invention, the thermosensitive element is provided with a protective layer. In general this protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating. A slipping layer, being the outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder.

Coating Techniques

The coating of any layer of the thermographic material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers.

Thermographic Processing

Thermographic imaging is carried out by the image-wise application of heat either in analogue fashion by direct exposure through an image or by reflection from an image, or in digital fashion pixel by pixel either by using an infra-red heat source, for example with a Nd-YAG laser or other infra-red laser, with a substantially light-insensitive thermographic material preferably containing an infra-red absorbing compound, or by direct thermal imaging with a thermal head.

In thermal printing image-signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200-1000 g/linear cm, i.e. with a contact zone (nip) of 200 to 300 μm a pressure of 5000 to 50,000 g/cm$^2$, to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

Industrial Application

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated.

Subbing layers on the emulsion side of the support:

Subbing layer Nr. 01 has the composition:

| | |
|---|---|
| copolymer of 88% vinylidene chloride, 10% methyl acrylate and 2% itaconic acid | 170 mg/m$^2$ |
| Kieselsol ® 100F, a colloidal silica from BAYER | 40 mg/m$^2$ |
| Mersolat ® H, a surfactant from BAYER | 0.85 mg/m$^2$ |
| Ultravon ® W, a surfactant from CIBA-GEIGY | 4.0 mg/m$^2$ |

Ingredients in the thermosensitive element in addition to the above-mentioned ingredients:

BL5HP=S-LEC BL5HP, a polyvinyl butyral from SEKISUI;

Oil=BAYSILON, a silicone oil from BAYER;

VL=DESMODUR VL, a 4,4'-diisocyanatodiphenylmethane from BAYER;

Reducing Agents:

R01=3,4-dihydroxybenzonitrile;

R02=3,4-dihydroxybenzophenone;

Toning Agent:

T01=7-(ethylcarbonato)-benzo [e][1,3]oxazine-2,4-dione;

T02=7-methyl-benzo [e][1,3]oxazine-2,4-dione;

Stabilizers:

S01=glutaric acid

S02=tetrachlorophthalic acid anhydride

S03=benzotriazole

Ingredients in the Protective Layer:

ERCOL™ 48 20=a polyvinylalcohol from ACETEX EUROPE;

LEVASIL™ VP AC 4055=a 15% aqueous dispersion of colloidal silica with acid groups predominantly neutralized with sodium ions and a specific surface are of 500 m$^2$/g, from BAYER AG has been converted into the ammonium salt;

ULTRAVON™ W=75-85% concentrate of a sodium arylsulfonate from Ciba Geigy converted into acid form by passing through an ion exchange column;

SYLOID™ 72=a silica from Grace;

SERVOXYL™ VPDZ 3/100=a mono [isotridecyl polyglycolether (3 EO)] phosphate, from SERVO DELDEN B.V.;

SERVOXYL™ VPAZ 100=a mixture of monolauryl and dilauryl phosphate, from SERVO DELDEN B.V.;

MICROACE TALC P3=an Indian talc from NIPPON TALC;

RILANIT™ GMS=a glycerine monotallow acid ester, from HENKEL AG

TMOS=tetramethylorthosilicate hydrolyzed in the presence of methanesulfonic acid.

COMPARATIVE EXAMPLES 1 AND 2 AND INVENTION EXAMPLES 1 TO 4

The substantially light-insensitive thermographic materials of COMPARATIVE EXAMPLES 1 and 2 and INVENTION EXAMPLES 1 to 4 were prepared by coating a dispersion with the following ingredients in 2-butanone onto a 175 μm thick blue-pigmented polyethylene terephthalate support with CIELAB a*- and b*-values of −9.5 and −17.9 respectively subbed on the emulsion-coated side with subbing layer 01 giving layers after drying at 50° C. for 1 h in a drying cupboard with the compositions given in Table 1.

TABLE 1

| | stabilizer | | | | R01 | R02 | T01 | T02 | S01 | S02 | | |
|---|---|---|---|---|---|---|---|---|---|---|---|---|
| | type | conc. mol % vs AgB | AgBeh coverage [g/m²] | BL5HP [g/m²] | mol % vs AgB | mol % vs AgB | mol % vs AgB | mol % vs AgB | mol % vs AgB | mol % vs AgB | VL [g/m²] | Oil [g/m²] |
| Comparative example nr. | | | | | | | | | | | | |
| 1 | — | 10 | 3.89 | 15.12 | 50 | 30 | 5 | 10 | 22 | 5 | 0.17 | 0.035 |
| 2 | S03 | 10 | 3.89 | 15.12 | 50 | 30 | 5 | 10 | 22 | 5 | 0.17 | 0.035 |
| Invention example nr | | | | | | | | | | | | |
| 1 | MTT-01 | 10 | 3.89 | 15.12 | 50 | 30 | 5 | 10 | 22 | 5 | 0.17 | 0.035 |
| 2 | MTT-02 | 10 | 3.89 | 15.12 | 50 | 30 | 5 | 10 | 22 | 5 | 0.17 | 0.035 |
| 3 | MTT-03 | 10 | 3.89 | 15.12 | 50 | 30 | 5 | 10 | 22 | 5 | 0.17 | 0.035 |
| 4 | MTT-04 | 10 | 3.89 | 15.12 | 50 | 30 | 5 | 10 | 22 | 5 | 0.17 | 0.035 |

The thermosensitive elements were then coated with an aqueous composition with the following ingredients, which was adjusted to a pH of 3.8 with 1N nitric acid, to a wet layer thickness of 85 μm and then dried at 50° C. for 15 minutes to produce a protective layer PRO-L with the composition:

ERCOL™48 20=2.1 g/m²

LEVASIL™ VP AC 4055=1.05 g/m²

ULTRAVON™W=0.075 g/m²

SYLOID™ 72=0.09 g/m²

SERVOXYL™ VPDZ 3/100=0.075 g/m²

SERVOXYL™ VPAZ 100=0.075 g/m²

MICROACE TALC P3=0.045 g/m²

RILANIT™ GMS=0.15 g/m²

TMOS=0.87 g/m² (assuming that the TMOS was completely converted to $SiO_2$)

After coating the protective layer was hardened by heating the substantially light-insensitive thermographic material at 45° C. for 7 days at a relative humidity of 70%.

Thermographic Printing

The substantially light-insensitive thermographic recording materials of COMPARATIVE EXAMPLES 1 and 2 and INVENTION EXAMPLES 1 to 4 were printed using a DRYSTAR™ 4500 printer from AGFA-GEVAERT with a resolution of 508 dpi which had been modified to operate at a printing speed of 14 mm/s and a line-time of 3.5 ms instead of 7.1 ms and in which the 75 μm long (in the transport direction) and 50 μm wide thermal head resistors were power-modulated to produce different image densities.

The maximum densities of the images ($D_{max}$) of fresh prints made with the substantially light-insensitive thermographic recording materials of COMPARATIVE EXAMPLES 1 and 2 and INVENTION EXAMPLES 1 to 4 were measured through a visible filter with a MACBETH™ TR924 densitometer and the image tone of assessed on the basis of the a* CIELAB-values at optical densities, D, of 1.0 and 2.0. The results are given in Table 2.

TABLE 2

| | stabilizer | Fresh film | | |
|---|---|---|---|---|
| | | | CIELAB-values of prints | |
| | type | Dmax | a* at D = 1.0 | a* at D = 2.0 |
| Comparative Example nr. | | | | |
| 1 | — | 2.9 | −3.18 | −0.66 |
| | | 3.0 | −2.93 | −0.33 |
| 2 | S03 | 2.8 | −3.82 | −1.29 |
| | | 2.7 | −1.96 | −0.13 |
| | | 2.8 | −1.87 | −1.16 |
| Invention Example | | | | |
| 1 | MTT-01 | 3.5 | +0.66 | +2.43 |
| 2 | MTT-02 | 3.4 | +0.38 | +3.07 |
| 3 | MTT-03 | 3.5 | +1.17 | +2.80 |
| 4 | MTT-04 | 3.6 | −0.57 | +1.61 |

The results in table 2 show that the Dmax values obtained with the substantially light-insensitive thermographic recording materials of INVENTION EXAMPLES 1 to 4 which contained 10 mol % of the mesionic 1,2,4-triazolium-3-thiolate compounds MTT-01, MTT-02, MTT-03 and MTT-04 respectively instead of 10 mol % benzotriazole were significantly higher than the Dmax values obtained with the substantially light-insensitive thermographic recording materials of COMPARATIVE EXAMPLES 1 and 2 without benzotriazole and with benzotriazole respectively.

Furthermore, fresh prints of the substantially light-insensitive thermographic recording materials of INVENTION EXAMPLES 1 to 4 substantially light-insensitive thermographic recording materials of INVENTION EXAMPLES 1 to 4 exhibited comparable CIELAB a*-values at densities of 1.0 and 2.0 to those obtained with the substantially light-insensitive thermographic recording materials of COMPARATIVE EXAMPLES 1 and 2 without benzotriazole and with benzotriazole respectively.

COMPARATIVE EXAMPLES 3 AND 4 AND INVENTION EXAMPLES 5 AND 6

The substantially light-insensitive thermographic materials of COMPARATIVE EXAMPLES 3 and 4 and INVENTION EXAMPLES-5 and 6 were prepared by coating a dispersion with the following ingredients in 2-butanone onto the support described for COMPARATIVE EXAMPLES 1 and 2 and INVENTION EXAMPLES 1 to 4 giving layers after drying at 85° C. for 3 minutes in a drying cupboard with the compositions given in Table 3.

TABLE 3

| | stabilizer of present invention | | AgBeh | | R01 mol % | R02 mol % | T02 mol % | S01 mol % | S02 mol % | | |
|---|---|---|---|---|---|---|---|---|---|---|---|
| | type | mol % vs AgB | coverage [g/m²] | BL5HP [g/m²] | vs AgB | vs AgB | vs AgB | vs AgB | vs AgB | VL [g/m²] | Oil [g/m²] |
| Comparative example nr. | | | | | | | | | | | |
| 3 | — | 10 | 4.15 | 16.6 | 35 | 45 | 15 | 24 | 4.91 | 0.19 | 0.037 |
| 4 | S03 | 10 | 4.15 | 16.6 | 35 | 45 | 15 | 24 | 4.91 | 0.19 | 0.037 |
| Invention example nr | | | | | | | | | | | |
| 5 | MTT-04 | 10 | 4.15 | 16.6 | 35 | 45 | 15 | 24 | 4.91 | 0.19 | 0.037 |
| 6 | MTT-06 | 10 | 4.15 | 16.6 | 35 | 45 | 15 | 24 | 4.91 | 0.19 | 0.037 |

The thermosensitive elements were then provided with a protective layer as described for COMPARATIVE EXAMPLES 1 and 2 and INVENTION EXAMPLES 1 to 4.

The thermographic properties of the substantially light-insensitive thermographic recording materials of COMPARATIVE EXAMPLES 3 and 4 and INVENTION EXAMPLES 5 and 6 were evaluated as described for COMPARATIVE EXAMPLES 1 and 2 and INVENTION EXAMPLES 1 to 4. The results are given in Table 4.

The results in table 2 show that the Dmax values obtained with the substantially light-insensitive thermographic recording materials of INVENTION EXAMPLES 5 and 6 which contained 10 mol % of the quaternary mesionic 1,2,4-triazolium-3-thiolate compounds MTT-04 and MTT-06 respectively instead of 10 mol % benzotriazole were significantly higher than the Dmax values obtained with the substantially light-insensitive thermographic recording materials of COMPARATIVE EXAMPLES 3 and 4 without benzotriazole and with benzotriazole respectively.

Furthermore, fresh prints of the substantially light-insensitive thermographic recording materials of INVENTION EXAMPLES 5 and 6 substantially light-insensitive thermographic recording materials of INVENTION EXAMPLES 1 to 4 exhibited comparable CIELAB a*-values at densities of 1.0 and 2.0 to those obtained with the substantially light-insensitive thermographic recording materials of COMPARATIVE EXAMPLES 3 and 4 without benzotriazble and with benzotriazole respectively.

TABLE 4

| | stabilizer | Fresh film | | |
|---|---|---|---|---|
| | | | CIELAB-values of prints | |
| | type | Dmax | a* at D = 1.0 | a* at D = 2.0 |
| Comparative Example nr. | | | | |
| 3 | — | 3.0 | −2.93 | −0.33 |
| 4 | S03 | 2.9 | −2.43 | +0.10 |
| Invention Example | | | | |
| 5 | MTT-04 | 3.4 | −2.38 | −0.27 |
| 6 | MTT-06 | 3.8 | −0.34 | +1.83 |

The present invention may include any feature or combination of features disclosed herein either implicitly or explicitly or any generalisation thereof irrespective of whether it relates to the presently claimed invention. In view of the foregoing description it will be evident to a person skilled in the art that various modifications may be made within the scope of the invention.

Having described in detail preferred embodiments of the current invention, it will now be apparent to those skilled in the art that numerous modifications can be made therein without departing from the scope of the invention as defined in the following claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, is including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A substantially light-insensitive black and white monosheet thermographic recording material comprising a support and a thermosensitive element, said thermosensitive element comprising a substantially light-insensitive organic silver salt, an organic reducing agent therefor in thermal working relationship therewith, a binder and at least one mesionic 1,2,4-triazolium-3-thiolate compound.

2. The thermographic recording material according to claim 1, wherein said mesionic 1,2,4-triazolium-3-thiolate compound is represented by formula (I):

(I)

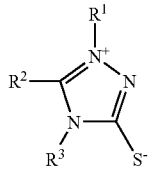

wherein $R^1$ and $R^3$ are independently an optionally substituted alkyl, alkenyl, alkynyl, cycloalkyl, heterocyclic, aryl, heteroaromatic, amido, carboxy, carboxy ester or acyl group; $R^2$ is a hydrogen or an optionally substituted alkyl, alkenyl, alkynyl, cycloalkyl, heterocyclic, aryl, heteroaromatic, alkoxy, thioalkoxy, carboxy, amido, carboxy ester, acyl, carbonato or carbonatoalkyl group; or $R^1$ and $R^2$ or $R^2$ and $R^3$ represent the atoms needed to close an optionally substituted heterocyclic ring.

3. The thermographic recording material according to claim 2, wherein said alkyl, alkenyl, alkynyl, cycloalkyl, aryl, heterocyclic and hetroaromatic groups of $R^1$, $R^2$ and $R^3$ are independently optionally substituted with fluorine atoms or an aryl, aryloxy, alkoxy, thioalkoxy, amido, carbonato, carbonatoalkyl, hydroxy, amino, carboxy or carboxyester group.

4. The thermographic recording material according to claim 2, wherein $R^1$ and $R^3$ are independently an alkyl group, an alkyl group substituted with a carboxyester group, an alkenyl, or an aryl group; $R^3$ is a $C_1$-$C_3$ alkyl group; and $R^1$, $R^2$ and $R^3$ are not all methyl groups.

5. The thermographic recording material according to claim 1, wherein said mesionic 1,2,4-triazolium-3-thiolate compound is

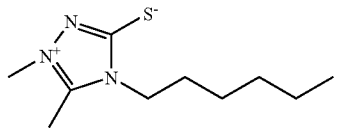

6. The thermographic recording material according to claim 1, wherein said mesionic 1,2,4-triazolium-3-thiolate compound is

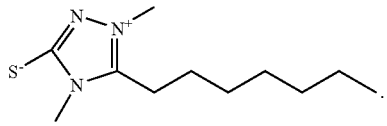

7. The thermographic recording material according to claim 1, wherein said mesionic 1,2,4-triazolium-3-thiolate compound is

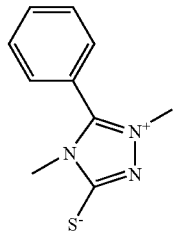

8. The thermographic recording material according to claim 1, wherein said mesionic 1,2,4-triazolium-3-thiolate compound is

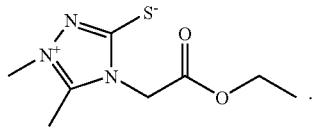

9. The thermographic recording material according to claim 1, wherein said mesionic 1,2,4-triazolium-3-thiolate compound is

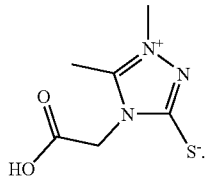

10. The thermographic recording material according to claim 1, wherein said mesionic 1,2,4-triazolium-3-thiolate compound is

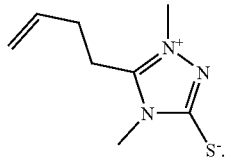

11. A process comprising the steps of: i) providing a substantially light-insensitive black and white monosheet thermographic recording material comprising a support and a thermosensitive element, said thermosensitive element comprising a substantially light-insensitive organic silver salt, an organic reducing agent therefor in thermal working relationship therewith, a binder and said at least one mesionic 1,2,4-triazolium-3-thiolate compound; and ii) image-wise heating said substantially light-insensitive black and white monosheet thermographic recording material, wherein the ratio of maximum optical density to the coverage of said substantially light-insensitive organic silver salt in $g/m^2$ is greater than the ratio of maximum optical density to the coverage of said substantially light-insensitive organic silver salt in $g/m^2$ said substantially light-insensitive black and white monosheet thermographic recording material in the absence of said at least one mesionic 1,2,4-triazolium-3-thiolate compound.

* * * * *